US005279420A

United States Patent [19]

Rodgers

[11] Patent Number: 5,279,420

[45] Date of Patent: Jan. 18, 1994

[54] HOLDER FOR DISPLAYING TUBULAR ARTICLES ON A RACK

[76] Inventor: J. Linn Rodgers, 7506 W. Ridge Rd., Elyria, Ohio 44035

[21] Appl. No.: 935,892

[22] Filed: Aug. 25, 1992

[51] Int. Cl.[5] ..... B65D 85/20

[52] U.S. Cl. ..... 206/446; 206/493; 206/806; 206/461; 40/668

[58] Field of Search ..... 206/446, 461, 493, 806, 206/477, 378; 40/663, 666, 667, 668, 669; 248/692

[56] References Cited

U.S. PATENT DOCUMENTS

| | | | |
|---|---|---|---|
| 3,402,435 | 9/1968 | Merser | 40/668 |
| 3,408,758 | 11/1968 | Doring | 206/493 |
| 3,963,123 | 6/1976 | Beal | 206/493 |
| 4,043,453 | 8/1977 | Greenlee | 206/493 |
| 4,373,632 | 2/1983 | Van Zandt | 206/806 |
| 4,425,999 | 1/1984 | MacDonald et al. | 206/493 |
| 4,632,242 | 12/1986 | Choi et al. | 206/806 |
| 4,682,690 | 7/1987 | Tiffany | 206/493 |

FOREIGN PATENT DOCUMENTS

| | | | |
|---|---|---|---|
| 2234807 | 1/1975 | France | 248/692 |

*Primary Examiner*—David T. Fidei
*Attorney, Agent, or Firm*—Donald D. Mon

[57] ABSTRACT

A holder for displaying tubular articles. A body has an integral spear, the spear having a tapered nose and a retention shoulder. A retention disc is snaped over the nose to retain on the holder a tubular article whose least lateral dimension is smaller than that of the body or of the disc.

9 Claims, 1 Drawing Sheet

HOLDER FOR DISPLAYING TUBULAR ARTICLES ON A RACK

FIELD OF THE INVENTION

This invention relates to a holder for displaying tubular articles on a rack to which the holder can be removably mounted and which when removed from the rack the articles are in a configuration which is both convenient to carry and difficult to shoplift or steal.

BACKGROUND OF THE INVENTION

Especially in the hardware and nursery aftermarkets, there is a wide range of tubular items for sale. Examples are hose fittings such as repair couplings and hose ends, and miscellaneous lengths of tubing with special end fittings, to name only a few. For maximum sales impact and convenience, these are preferably displayed on racks rather than in bins. The presently-preferred rack display is a card which is enclosed with the articles in a shrink wrapping. An aperture in the card passes a hook that is mounted to a rack or pegboard.

In addition to visibility, this arrangement has the advantage that it is inconvenient for a shoplifter. Certainly it is less convenient to steal than the device Which it displays, if only because of its shape and size, Still, however conventional and useful this may be, it still involves the cost of the backing card, the wrapping material, and the labor to assemble it. Also, when assembled its inherent bulkiness takes up considerable volume for shipping, and requires care in packing to keep the packed volume to a minimum.

It is an object of this invention to provide a holder which itself can be attached to a rack. One size of this holder can accommodate a wide range of lateral and axial lengths, all without rattling. Its own dimensions are such that an assembly with it can fit into minimum packing space, but still will be inconvenient for a shoplifter.

It is another object of this invention to hold the assembly in reasonably good alignment for making a neat display, and to hold it against excessive rattling both in storage and while being carried.

BRIEF DESCRIPTION OF THE INVENTION

A holder according to this invention includes a body adapted to be attached to a rack, the body including an axially-extending spear. The spear terminates at a retainer which has a tapered nose and a retention shoulder. A retainer disc has an aperture through which the nose can pass. Either the nose or the disc adjacent the aperture, or both, is sufficiently flexible that the disc can be forced past the nose to snap over and seat against the shoulder so as to be retained to the spear after the spear has passed through the article or articles to be retained. An article is then retained on the spear between the body and the retainer disc.

Preferably, but optionally, the disc is slotted and tapered, so as to facilitate pressing the disc over the nose, and to frustrate its removal A plurality of stiffly-flexible fingers are integral with the spear. They are spaced from the shoulder, and slant away from the spear as they extend in the direction away from the free end of the spear.

The body itself has a lateral dimension larger than the least internal lateral dimension of the object to be retained, as does the disc.

The above and other features of this invention will be fully understood from the following detailed description and the accompanying drawings, in which:

DETAILED DESCRIPTION OF THE INVENTION

Figure 1:
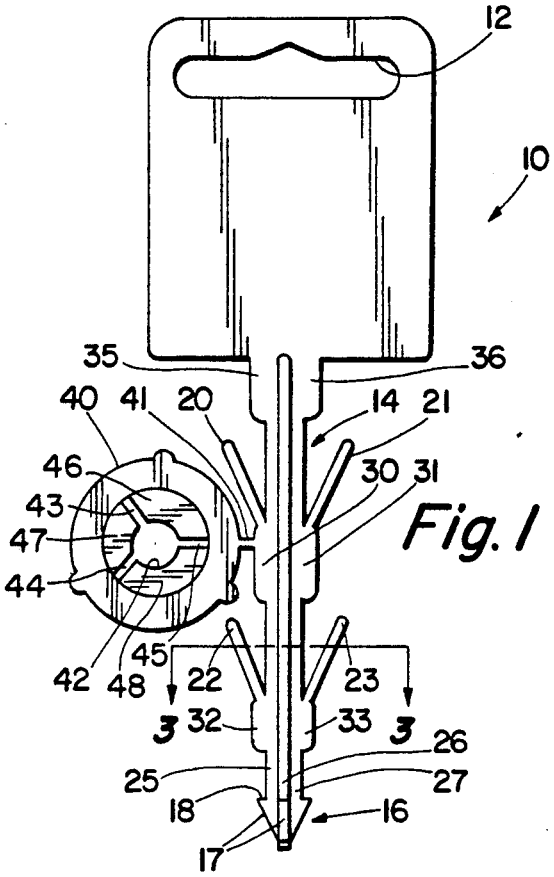
FIG. 1 is a plan view of the preferred embodiment of a holder according to this invention, in its molded form before use.

The presently-preferred embodiment of a holder 10 is shown in FIG. 1. Conveniently it can be injection-molded from any suitable inorganic plastic material. Metal or compressed paper coated to resist moisture can also be used, for example.

The holder includes a body 11 having an aperture 12 through which a hook or other means to mount the holder to a support such as a rack can be passed. A spear 14 integral with the body has a linear axis 15, and extends axially from the body.

At its free end 16, the spear includes a tapered nose 17 which enlarges as it extends from end 16, and terminates at a retention shoulder 18.

A first pair of fingers 20,21 are integral with the spear. They slant away from the axis as they extend in a direction away from the free end. They are stiffly flexible, and their ends extend far enough from the spear so that they will contact the inside wall of any object which is expected to be mounted by the holder.

A second pair of fingers 22,23 is also provided, preferably identical to fingers 20 and 21. This enables a plurality of objects to be side-supported, or a larger one to be kept in better alignment.

Four splines 25,26,27,28 form the structure of the spear, the fingers being extensions from to of them. Reinforcements 30,31,32,33 provide an improved base for the respective fingers, and protect them from damage when they intersect their respective splines.

A pair of pads 35,36 contiguous to the body limit the lateral excursion of the mounted body. These are optional, but can be convenient.

A retainer disc 40, may conveniently be molded along with the remainder of the holder. A thin strand 41, which is easily parted, is formed in the molding process and holds it temporarily to the spline. An aperture 42 through the disc is preferably circular. Either the disc adjacent to the wall of the aperture, or the nose, or both, is or are sufficiently deflectible so as to enable the nose to be forced through the aperture so the disc snaps over it and against the shoulder. The disc will then be retained, except against a strong removal force, or more likely by the cutting of the disc.

Figure 5:
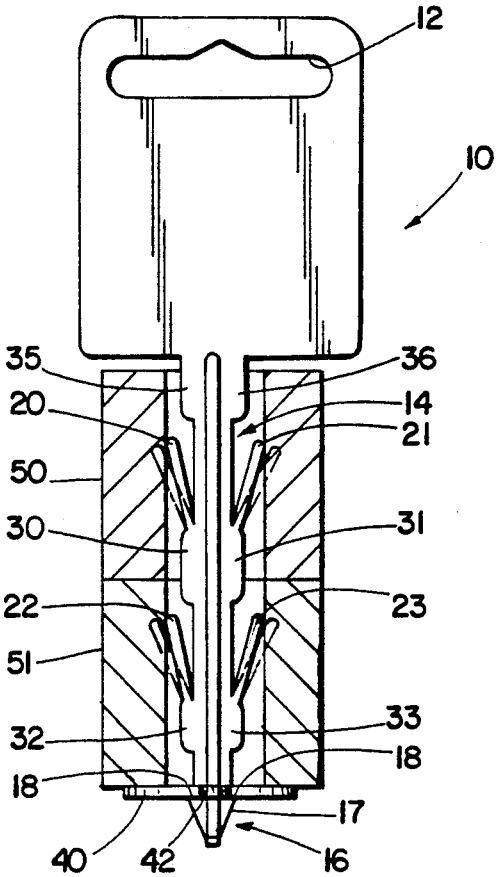
FIG. 5 is an axial cross-section of the holder of FIG. 1, shown mounting two objects for display.
Figure 2:
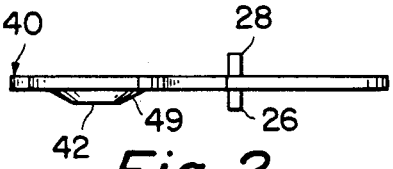
FIG. 2 is a bottom view of FIG. 1.

The presently-preferred arrangement is to form radial slots 43,44,45, extending from the aperture, which will create fingers 46,47,48. These slots are cut in a central, frusto conical portion 49 of the disc. As shown in FIGS. 2 and 5, the fingers then slant toward the retention shoulder after having been pressed over the nose. The taper assists the assembly, and the fingers strongly resist axial removal.

Figure 6:
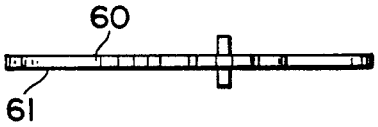
FIG. 6 is a bottom view of another embodiment of the holder of FIG. 1.
Figure 4:
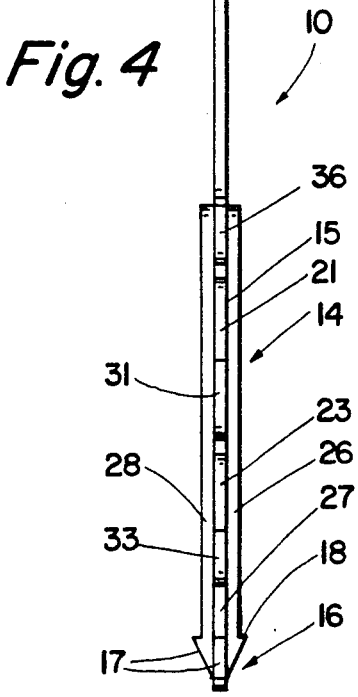
FIG. 4 is a right hand side view of FIG. 1.
Figure 3:
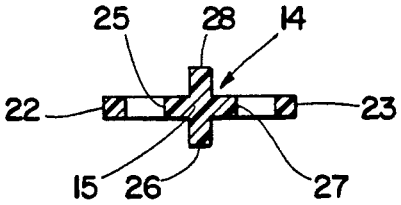
FIG. 3 is a cross-section taken at line 3—3 in FIG. 1.

FIG. 6 shows that neither the taper nor the slots are necessary. Disc 60 is a planar, unslotted disc with a circular aperture 61. The disc will be forced over the nose when the articles are properly proportioned.

The use of the holder is straight forward. The disc is removed from the molded assembly. The spear is passed through articles 50,51, which are to be retained, and then the disc is snapped past the nose and bears against the retention shoulder. The article is then reliably held to the holder. It can only be removed by pulling off the disc, of by cutting the disc. Because the shoulder is abrupt, a strong pull will be required. A shoplifter will have a difficult time doing this without being noticed. If he must cut it, the theft is made even more difficult.

Also, the assembly of the holder and the articles, while neat and quite compact, is inconvenient to hide. Its envelope dimensions vary from a flat plate to one or more articles of various shapes, which in most cases will be rather loose, because one length of spear will be used for many combinations of articles whose axial length will often be less than the spacing between the body and the retention shoulder. The assembly is convenient for the shipper and for the merchant, but very inconvenient for the shoplifter.

The body provides the additional advantage that its flat surfaces can carry one or more labels. The preferred label arrangement is one with a single fold, and with an adhesive backing. The holder is thereby readily adaptable to identify and hold a wide variety of articles.

In the Figs, two cylindrical articles are shown for convenience and disclosure. Instead, it could be a longer single article, and the articles will most often not be pure cylinders. They may be such as screw caps, hose adapters, and clamps, for example.

It will be observed that when the articles are on the spear, the fingers will have been deflected. While lateral movement is still possible, the usual effect is for the fingers on the spear to tend to center the articles, and to keep them in a neat arrangement parallel to the axis of the spear. Furthermore, they tend to reduce rattling of the articles against themselves and against the spear.

This invention is not to be limited by the embodiments shown in the drawings and described in the description, which are given by way of example and not of limitation, but only in accordance with the scope of the appended claims.

I claim:

1. A holder to hold tubular articles of the type which have a passage therethrough, said passage having at least one lateral dimension, said holder comprising:

a body having an opening therethrough;

a rigid elongated spear integral and continuous with said body and extending away therefrom, said spear having an axis of elongation, said spear having an end spaced from said body, a tapered nose at said end enlarging as it extends away from said end to an edge spaced from said end, a retention shoulder at said edge facing toward said body, a plurality of springily flexible fingers integral with and projecting from said spear, spaced from said edge, and slanting away from said spear as they extend in a direction away from said end; and a retainer disc having an aperture and an outer periphery large than the smallest said lateral dimension of said passage in an article expected to be held, said disc at said aperture, or said nose, being sufficiently deflectable as to permit said disc to be pressed over and past said edge so as to engage said retention shoulder, said body also having a lateral dimension larger than the smallest lateral dimension of an article to be retained, whereby the article will be held between the body and the retainer disc when the disc bears against the retention shoulder.

2. A holder according to claim 1 in which the spear is generally cruciform in cross-section, and in which the fingers are provided in pairs, the members of each pair being on opposite sides of the spear from one another.

3. A holder according to claim 1 in which the body is a flat plate, and in which the opening in the plate lies on the axis of the spear.

4. A holder according to claim 1 in which the retention disc is tapered near its aperture.

5. A holder according to claim 1 in which radial slots are formed in said disc, which radiate from said aperture.

6. A holder according to claim 4 in which radial slots are formed in said disc, which radiate from said aperture.

7. In combination:

a tubular article having a passage therethrough; and a holder according to claim 1, said spear passing through said passage in the article, said article thereby being held on the spear between the body and the disc.

8. A combination according to claim 7 in which the spear is generally cruciform in cross-section, and in which the fingers are provided in pairs, the members of each pair being opposite from one another.

9. A combination according to claim 8 in which radial slots are formed in said disc, which radiate from said aperture.

* * * * *